US007641030B2

(12) United States Patent
Selvi

(10) Patent No.: US 7,641,030 B2
(45) Date of Patent: Jan. 5, 2010

(54) EXPANDABLE HARD SUITCASE WITH STITCHED FASTENER

(75) Inventor: Sedat Selvi, London (GB)

(73) Assignee: Landor & Hawa International Limited, Harlow (GB)

( * ) Notice: Subject to any disclaimer, the term of this patent is extended or adjusted under 35 U.S.C. 154(b) by 262 days.

(21) Appl. No.: 11/548,837

(22) Filed: Oct. 12, 2006

(65) Prior Publication Data

US 2007/0045072 A1 Mar. 1, 2007

Related U.S. Application Data

(63) Continuation of application No. 10/537,426, filed as application No. PCT/GB2004/002736 on Jun. 25, 2004, now Pat. No. 7,143,878.

(30) Foreign Application Priority Data

Jun. 27, 2003 (GB) ..... 0315031.5
Dec. 22, 2003 (GB) ..... 0329525.0

(51) Int. Cl.
*A45C 7/00* (2006.01)
*A45C 5/02* (2006.01)
*A45C 5/14* (2006.01)

(52) U.S. Cl. ..... 190/40; 190/18 R; 190/18 A; 190/103; 190/903; 383/97; 383/907

(58) Field of Classification Search ..... 190/18 R, 190/100, 103, 106, 903, 40, 124, 125; 206/422; 383/907, 97
See application file for complete search history.

(56) References Cited

U.S. PATENT DOCUMENTS

D21,154 S 11/1891 Officer
2,030,360 A * 2/1936 Dyer ..... 190/117
3,158,238 A 11/1964 Kish, Jr.
3,443,671 A 5/1969 Dyke
3,496,795 A 2/1970 Dinnendahl
3,549,164 A 12/1970 Raynor
3,606,372 A 9/1971 Browning
3,799,568 A 3/1974 Hager
3,865,166 A 2/1975 Pedro (Continued)

FOREIGN PATENT DOCUMENTS

CN 2376780 Y 5/2000

(Continued)

OTHER PUBLICATIONS

Complaint, *Landor & Hawa U.S.A., Ltd., and Landor & Hawa International, Ltd.* vs. *Traveler's Club Luggage, Inc.*, U.S. District Court for the Southern District of Indiana, Indianapolis Division, Case No. 1:06-cv-0528-DFH-TAB.

(Continued)

*Primary Examiner*—Sue A Weaver
(74) *Attorney, Agent, or Firm*—Barnes & Thornburg LLP

(57) ABSTRACT

A hard suitcase includes a base portion and a lid portion each formed of a plastics material of such characteristic that the base and lid portions retain their intended shape. The hard suitcase also includes a zip fastener arrangement that is stitched to the base and lid portions. The zip fastener arrangement has an expandability feature to permit volume expansion of the hard suitcase.

17 Claims, 4 Drawing Sheets

U.S. PATENT DOCUMENTS 4,037,858 A 7/1977 Adams
4,050,708 A 9/1977 Samardzija et al.
4,087,102 A 5/1978 Sprague
4,128,150 A 12/1978 Popkin et al.
4,153,146 A * 5/1979 Patton et al. ..... 190/103
4,287,971 A 9/1981 Doulet
4,294,463 A 10/1981 Kotani
4,368,835 A 1/1983 Murphy
4,538,709 A 9/1985 Williams et al.
4,540,196 A 9/1985 Paping et al.
D282,787 S 2/1986 Nichols
4,588,056 A 5/1986 Bernbaum
4,616,379 A 10/1986 Lio
4,637,626 A 1/1987 Foss et al.
4,703,519 A 10/1987 Krenzel
4,887,835 A 12/1989 Dallaire et al.
5,002,304 A 3/1991 Carrigan, Jr.
5,004,091 A 4/1991 Natho et al.
5,048,649 A 9/1991 Carpenter et al.
D324,871 S 3/1992 Cordet et al.
5,109,961 A 5/1992 Bergman
5,111,919 A 5/1992 Hamatani et al.
5,114,164 A 5/1992 Bothwell et al.
5,228,546 A 7/1993 Chang et al.
5,249,438 A 10/1993 Rhaney et al.
5,323,887 A 6/1994 Scicluna et al.
5,339,934 A 8/1994 Liang
5,358,082 A 10/1994 Armstrong, IV
5,367,743 A 11/1994 Chang
5,377,795 A 1/1995 Berman
5,429,317 A 7/1995 Yamaguchi
5,431,428 A 7/1995 Marchwiak et al.
5,464,080 A 11/1995 Liang
5,464,081 A 11/1995 Zwanzig
5,469,945 A 11/1995 Jserng
5,491,872 A 2/1996 Tserng
5,497,865 A 3/1996 Yun-Pi
5,547,053 A 8/1996 Liang
5,564,538 A 10/1996 Sadow
D375,202 S 11/1996 Vermillion et al.
5,575,362 A 11/1996 Franklin et al.
5,586,628 A 12/1996 Wang
5,588,569 A * 12/1996 Mitomi et al. ..... 224/153
5,615,757 A 4/1997 Chen
5,630,521 A 5/1997 Waddell et al.
5,647,095 A 7/1997 Takimoto
5,671,831 A 9/1997 Chiu
5,689,854 A 11/1997 Wang
D387,198 S 12/1997 Lehmann et al.
5,699,886 A 12/1997 Latshaw
5,706,921 A 1/1998 Wang
5,709,398 A 1/1998 Lu
5,713,441 A 2/1998 Chen
5,725,090 A 3/1998 Vermillion et al.
5,749,503 A 5/1998 Wulf et al.
D395,361 S 6/1998 Zionts et al.
5,758,752 A 6/1998 King et al.
5,769,194 A 6/1998 Chang
5,779,248 A 7/1998 Gold et al.
5,785,427 A 7/1998 Godshaw
5,813,504 A 9/1998 Iny et al.
5,833,039 A 11/1998 Kotkins, Jr.
5,865,281 A 2/1999 Wang
5,868,406 A 2/1999 Sadow
5,881,932 A 3/1999 Wadden
5,884,362 A 3/1999 Tsai
5,890,570 A 4/1999 Sadow
5,893,495 A 4/1999 Godshaw et al.
5,901,822 A 5/1999 Tu
5,908,093 A 6/1999 Miyoshi
5,943,936 A 8/1999 Deliman et al.
5,984,154 A 11/1999 Scicluna
6,009,598 A 1/2000 Chang
6,032,771 A 3/2000 Pedrini
6,041,900 A 3/2000 Sadow et al.
6,059,078 A 5/2000 Nykoluk
6,059,301 A 5/2000 Skarnulis
6,122,800 A 9/2000 Cheng
6,129,365 A 10/2000 Sadow
6,148,477 A 11/2000 Cheng
6,179,101 B1 1/2001 Lin
6,179,176 B1 1/2001 Saggese et al.
6,193,033 B1 2/2001 Sadow et al.
6,202,254 B1 3/2001 Ezer
6,220,411 B1 4/2001 Scicluna et al.
6,227,339 B1 5/2001 Bogert
6,237,734 B1 5/2001 Chen
D443,136 S 6/2001 Fusi
6,279,706 B1 8/2001 Mao
6,298,964 B1 10/2001 Sadow
6,305,513 B1 10/2001 Lu
6,345,709 B1 2/2002 Cheng
6,357,567 B1 3/2002 Tsai
6,390,259 B1 5/2002 Lu
6,408,997 B1 6/2002 Chen
6,434,790 B1 8/2002 Chen
6,505,720 B1 1/2003 Tsai
6,508,344 B1 1/2003 Lu
6,533,087 B1 3/2003 Chen
D475,199 S 6/2003 Nykoluk
6,575,272 B1 6/2003 Krulik et al.
6,591,950 B1 7/2003 Scicluna
6,591,951 B1 7/2003 Chen
6,595,354 B1 7/2003 Scicluna
D477,916 S 8/2003 Nykoluk
6,609,598 B2 8/2003 Hsu
D480,194 S 9/2003 Tsai
D481,206 S 10/2003 Nykoluk
6,644,448 B2 11/2003 Bernbaum et al.
6,651,791 B1 11/2003 Nykoluk et al.
D489,902 S 5/2004 Nykoluk
D491,361 S 6/2004 Bernbaum et al.
D493,619 S 8/2004 Nykoluk
D495,879 S 9/2004 Bernbaum et al.
6,902,077 B1 * 6/2005 Tack et al. ..... 220/259.1
D507,405 S 7/2005 Kim et al.
6,918,474 B2 7/2005 Nykoluk
6,942,077 B1 9/2005 Nykoluk
7,143,878 B2 12/2006 Selvi
7,322,452 B2 1/2008 Nykoluk
7,322,583 B2 1/2008 Kim et al.
2001/0013452 A1 * 8/2001 Tiramani et al. ..... 190/124
2002/0096410 A1 7/2002 Nykoluk
2002/0130004 A1 9/2002 Lin
2002/0185350 A1 12/2002 Chang et al.
2003/0000784 A1 1/2003 Hsu
2003/0006110 A1 * 1/2003 Lin et al. ..... 190/18 A
2003/0079950 A1 5/2003 Lin et al.
2003/0085089 A1 5/2003 Lin et al.
2003/0102195 A1 6/2003 Mittleman et al.
2003/0132080 A1 7/2003 Dababneh
2004/0031654 A1 2/2004 Chang
2004/0035661 A1 2/2004 Krulik et al.
2004/0045780 A1 3/2004 Bernbaum et al.
2004/0094583 A1 5/2004 Bernbaum et al.
2004/0211635 A1 10/2004 Lu
2005/0067244 A1 3/2005 Smith et al.
2005/0156003 A1 7/2005 Nykoluk

FOREIGN PATENT DOCUMENTS

CN 2511175 Y 9/2002
DE 20301888 U1 5/2003
EP 0 719 511 A1 12/1995

| | | | |
|---|---|---|---|
| EP | 1 228 713 | A2 | 8/2002 |
| EP | 1 228 713 | A3 | 3/2003 |
| FR | 2318602 | | 2/1977 |
| GB | 2 173 393 | A | 10/1986 |
| GB | 2338890 | | 12/2000 |
| GB | 2 366 512 | A | 3/2002 |
| GB | 2 372 981 | A | 11/2002 |
| JP | 965929 | | 3/1997 |
| JP | 9-285329 | | 11/1997 |
| WO | WO 93/05943 | | 4/1993 |
| WO | WO 96/38066 | | 12/1996 |
| WO | WO 98/07344 | | 2/1998 |

OTHER PUBLICATIONS

Answer and Counterclaims, *Landor & Hawa U.S.A., Ltd., and Landor & Hawa International, Ltd.* vs. *Traveler's Club Luggage, Inc., Traveler's Club Luggage, Inc.* vs. *Landor & Hawa U.S.A., Ltd., and Landor & Hawa International, Ltd.*, U.S. District Court for the Southern District of Indiana, Indianapolis Division, Case No. 1:06-cv-0528-DFH-TAB.

Reply to Counterclaims, *Landor & Hawa U.S.A., Ltd., and Landor & Hawa International, Ltd.* vs. *Traveler's Club Luggage, Inc.*, U.S. District Court for the Southern District of Indiana, Indianapolis Division, Case No. 1:06-cv-0528-DFH-TAB.

Compliant, *Landor & Hawa U.S.A., Inc. and Landor & Hawa International, Ltd.* vs *Heys U.S.A., Inc.* iand Heys International, Ltd., U.S. District Court for the Southern District of Indiana, Indianapolis Division, Case No. 05-cv-0962-LJM-WTL.

Landor & Hawa International Ltd. V. Azure Designs Ltd, (Oct. 10-12 and Nov. 28, 2005), pp. 427-443.

ABS Expander Troley Case, "Fashion Extras", Jan./Feb. 2003, pp. 25-26.

* cited by examiner

EXPANDABLE HARD SUITCASE WITH STITCHED FASTENER

CROSS REFERENCE TO RELATED APPLICATIONS

This application is a continuation of U.S. patent application Ser. No. 10/537,426, filed Jun. 2, 2005, now U.S. Pat. No. 7,143,878, which is hereby incorporated by reference herein, and which claimed priority under 35 U.S.C. §371 as a U.S. national counterpart application of international serial no. PCT/GB2004/002736, filed Jun. 25, 2004, which claimed priority to British applications serial nos. 0315031.5 and 0329525.0 filed Jun. 27, 2003 and Dec. 22, 2003, respectively.

BACKGROUND OF THE INVENTION

This invention relates to the construction of luggage such as suitcases for use by travellers.

Many constructions of suitcases for use by travellers are known. These known constructions are of varied form and not infrequently include at least a pair of wheels/rolls for facilitating the movement of the case by a user.

In addition, it is also known to provide suitcases incorporating a towing handle structure which is usually moveable between a user case towing position and a retracted stowage position.

Suitcases, can conveniently be considered as comprising two major types, the first the so-called soft case and the second the so-called hard case.

The soft case conventionally incorporates a metal or plastics framework which provides the means whereby the required shape and visual appearance of the case is maintained and also serves to support a soft outer covering.

The above mentioned hard skinned cases are regarded as being hard skinned in the sense that the walls, top and bottom are so moulded or otherwise pre-formed as to provide a substantially rigid or hard skin in the sense that the walls, top and bottom are formed by a material that is sufficiently rigid in that it retains its shape and form in use. A material commonly used for forming hard skinned cases is a polypropylene.

Such cases comprise two rigid shells that are hinged one to the other with purpose built hinges and which meet with an inter-nesting tongue and groove frame-like formation. Mechanical fasteners such as hinged locks are used to retain the lid portion and the base portion in their closed positions.

Conventionally the so-called 'hard' cases incorporate a metal or plastics framework extending all around the internal perimeter of the case in such position as to provide structural strength to the case and additionally to ensure that any internal tongue and groove arrangements will always nest one relative to the other.

Bearing in mind that many present day modes of travel, i.e., by aircraft, coach, etc., impose a weight limit upon the amount of luggage an individual passenger may carry, it has been found that whilst the known hard case constructions afford a considerably higher degree of security and resistance to damage, the extra weight of the case imposes considerable limitations upon the actual weight of articles that may be introduced into the case.

On the other hand, whilst the lighter weight of the soft case allows more articles to be packed into the case, weight for weight the lesser security afforded by the soft case constructions against damage, deliberate or otherwise, introduces unacceptable content security problems for the traveller.

SUMMARY OF THE INVENTION

It is an object of the present invention to provide, inter alia, a 'hard' suitcase construction that avoids at least some of the problems arising from the use of the known construction of hard and soft type cases.

For the purposes of the present Application a 'hard' case is regarded as being such by reason of the fact that the top, bottom, side and end walls cannot readily be pierced by a blade or needle as is the case with known soft case constructions.

A further object is the provision of a suitcase whose appearance departs from that of a purely standard rectangular block like formation for a suitcase.

Broadly according to a first aspect of the invention there is provided a method of constructing a hard suitcase including forming a shaped base portion and a shaped lid portion from a plastics material of such characteristic that the portions retain their intended shape, and attaching to each of said portions the respective zipped portions of a zip fastener arrangement by a stitching operation involving a securing thread.

A further aspect of the invention provides a method of constructing a frameless 'hard' suitcase characterised by the steps of forming a base portion and a lid portion from a material of such characteristic that the portions retain their formed shape, and attaching to each of said portions the respective zipped portions of a zip fastener arrangement by a stitching operation involving a securing thread.

According to a further aspect of the invention, there is provided a method of constructing a frameless 'hard' curvilinear suitcase characterised by the steps of forming a tray like base portion and a tray like lid portion from a material of such characteristics that the base and lid portions retain their intended curvilinear shape, and attaching to the free edge regions of the walls of said tray like portions by a stitching operation using a thread, the respective fastener forming sections of a zip fastener arrangement for enabling the base and lid portions to be retained in a suitcase closed condition.

In accordance with a still further aspect of the invention there is provided a method of constructing a suitcase incorporating a capability of increasing the storage volume of the case.

Preferably a means, for enabling said increase in the closed volume of the suitcase includes a Zip fastener arrangement.

Conveniently the zip fastener arrangement is a two part Zip fastener arrangement. In accordance with a second aspect of the invention, there is provided a method of constructing a hard suitcase including forming a base portion and a lid portion from a material of such characteristic that the portions retain their formed shape, and attaching to each of said portions the respective zipped portions of a zip fastener arrangement by a stitching operation involving a securing thread.

In accordance with a further aspect of the invention there is provided a method of constructing a suitcase including forming a tray like base portion and a tray like lid portion from a material of such characteristic that the portions retain their formed shape, and attaching to each of said portions the respective zipped sections of a zip fastener arrangement by a stitching operation involving a securing thread, the Zip fastener arrangement being such as to enable the suitcase to be retained in a closed condition, and incorporating means for enabling increase in the storage volume of the closed suitcase.

Preferably a suitcase is provided with two sets of floor engaging support members, there being a set being provided one to each of two transverse surfaces of the suitcase whereby the case can be stood on a support surface in one or the other of two orientations.

In a preferred construction two of the elements of one such set are provided upon the bottom portion and incorporate wheels/rolls whereby the case is rendered towable, and in which at least one other element of this set is located on the lid portion, the arrangement being such as to provided a stable support for the case when not being towed.

In a preferred construction that side of the base portion that is opposite to the wheels/rolls is provided with a case carrying handle and a retractable towing means.

Preferably, two elements of the second such set are provided upon a longer side wall of the base portion and two further elements of this set are provided upon a corresponding wall of the lid portion, the arrangement being such that the case when resting on the elements of this set is stable, and wherein a carrying handle is provided on the side of the bottom portion that is opposite to the side with said elements.

In a further preferred construction the case incorporates means whereby the volume of the case is expandable.

Conveniently, the expandability is achieved by providing a two part Zip fastener arrangement of which a first Zip part is associated with the closing of the case and of which a second Zip part is associated with the expandability of the case.

Preferably, the second Zip part is interposed between the lid section of the case and the portion of the Zip fastener arrangement associated with the closure of the case.

Conveniently, the second Zip part includes a first section attached to the case and additionally along the peripheral edge of a strip of flexible material circumscribing the mouth of the lid portion and attached thereto, and a second section that is attached to the peripheral edge of the strip of material that is remote from the case lid portion.

BRIEF DESCRIPTION OF THE DRAWINGS

For a better understanding of the invention and to show how to carry the same into effect reference will now be made to the accompanying drawings in which.

DETAILED DESCRIPTION OF THE DRAWINGS

Figure 2:
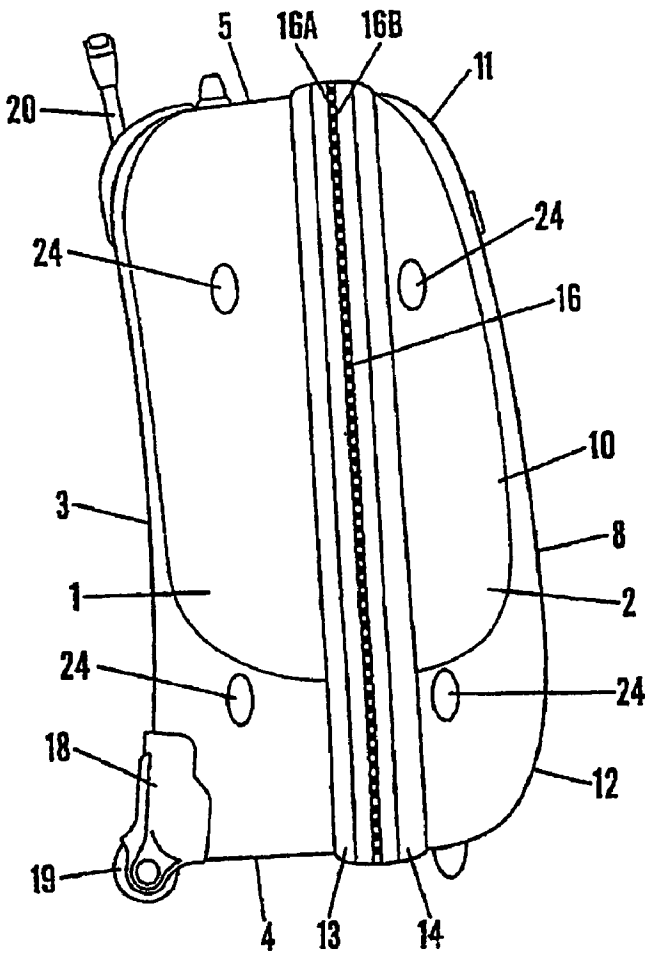
FIG. 2 is a view of the opposite side to carrying handle side of a solid skinned suitcase case shown in FIG. 1.

Referring to the drawings, the suitcase shown therein includes a main body or base portion 1 and a lid portion 2. Both the base portion and the lid portion are formed from a plastics material of such nature that the portions are self supporting and at the same time are capable of being stitched to a Zip fastener arrangement as will be discussed hereinafter.

In a particular construction the material used for the lid and base portions is a mixture of polycarbonate material with an Acrylic Butyl Styrene (ABS) plastics of the kind conventionally used for hard side framed luggage.

As seen in the orientation of the suitcase as shown in FIGS. 1 to 4, the base portion 1 includes a bottom main surface 3, longer shorter side walls 4 and 5, and longer side walls 6 and 7.

Figure 1:
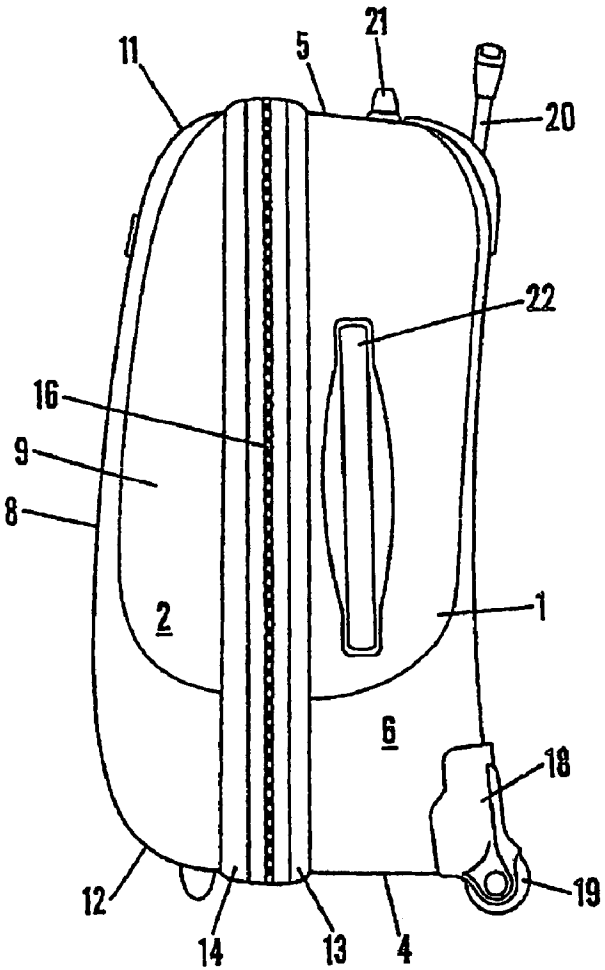
FIG. 1 is a view of the carrying handle side of a first embodiment of a solid skinned suitcase case incorporating the concepts of the invention.

Also as seen the FIGS. 1 and 2 the lid portion 1 can be regarded as including a top main surface 8, side walls 9 and 10 and smoothly curved regions 11 and 12 that can be regarded as forming the remaining walls of the lid portion.

Since the lid and base portions are intended to connect one with the other when the suitcase is closed, as is shown in the Figures, the main body portion 1 and the lid portion 2 are respectfully formed with complementary profiled stiffening ribs 13 and 14 respectively.

Figure 3:
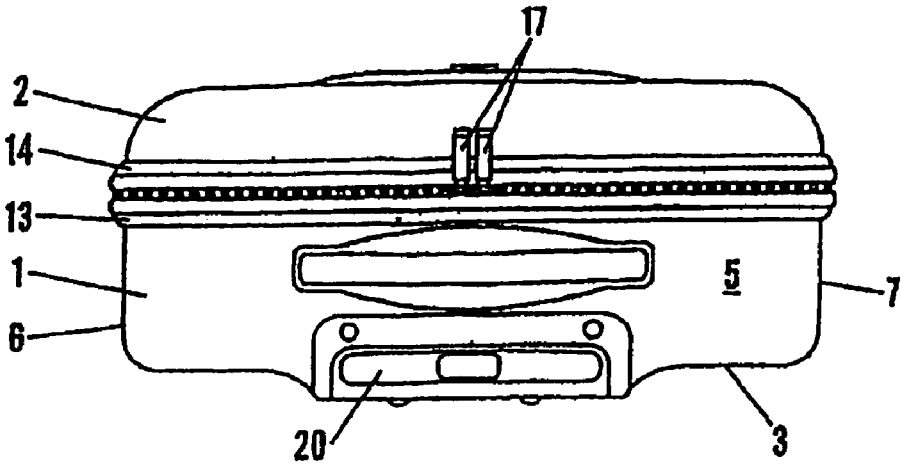
FIG. 3 is a top view of the suitcase as shown in FIGS. 1 and 2.
Figure 4:
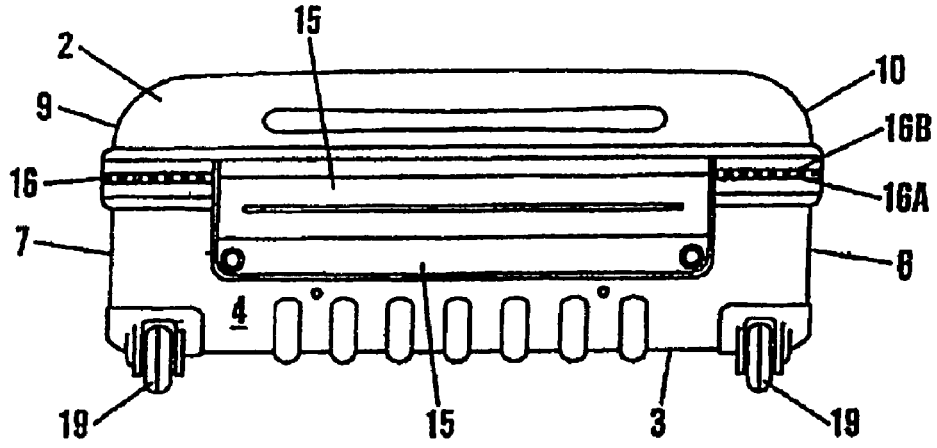
FIG. 4 is a bottom view of the suitcase as shown in FIGS. 1 and 2.

In the embodiment of the suitcase as shown in the Figures, the lid portion is pivotally secured to the base portion by a hinging arrangement 15 schematically shown in FIG. 4, and is maintained in its closed position by a circumscribing Zip fastener arrangement 16 including two operating members 17 which can be set to allow the lid portion 2 to be pivoted to an open position, and when the two operating elements are moved to the positions shown in FIG. 3, the lid section is held in its closed position as shown. In practice, these members 17 can be such as to accept the hasps of a lock that prevents separation of the members when the lock is in place.

The Zip fastener arrangement 16 includes conventional Zip toothed strips/sections 16A and 16B that are connected to the stiffening ribs regions of the base portion and the lid portion by machine stitching. The mode of securing the Zip fastener arrangement to the lid and base sections will be considered in more detail herein after. For the present, it will be noted that the provision of the Zip fastener arrangement 16 with its toothed strips/sections 16A and 16B and operating members 17 mounted to the base and lid portions affords an all around closure to the case, whilst at the same time, eliminating the need for a tongue and grove engagement region between the lid and base portions and mechanical closures such as locks.

The suitcase incorporates a user towing facility. Thus the suitcase is provided at two corners of the base portion with wheel mounting units 18. As can be seen from FIG. 4 the units each include a shaped housing 18 that is secured to the suitcase corners. In the case of each housing 18 a wheel 19 is suitably mounted in the housing 18 such that the wheel projects rearwards and downwards of the base portion 1.

A towing handle assembly 20 is provided in the base portion 1. This handle assembly is housed within the structure of the base portion so that when not in use its is retractable into an effectively concealed position. Thus the base portion is moulded with suitable recess for accommodating the handle assembly.

In use the handle is pulled upwardly (as indicated in the Figures) to a fully extended user position.

A first suitcase carrying handle 21 is secured to the base section at a location adjacent to the towing handle location. A second suitcase carrying handle 22 is secured to the base portion, this latter handle being on the longer wall 6.

Figure 6:
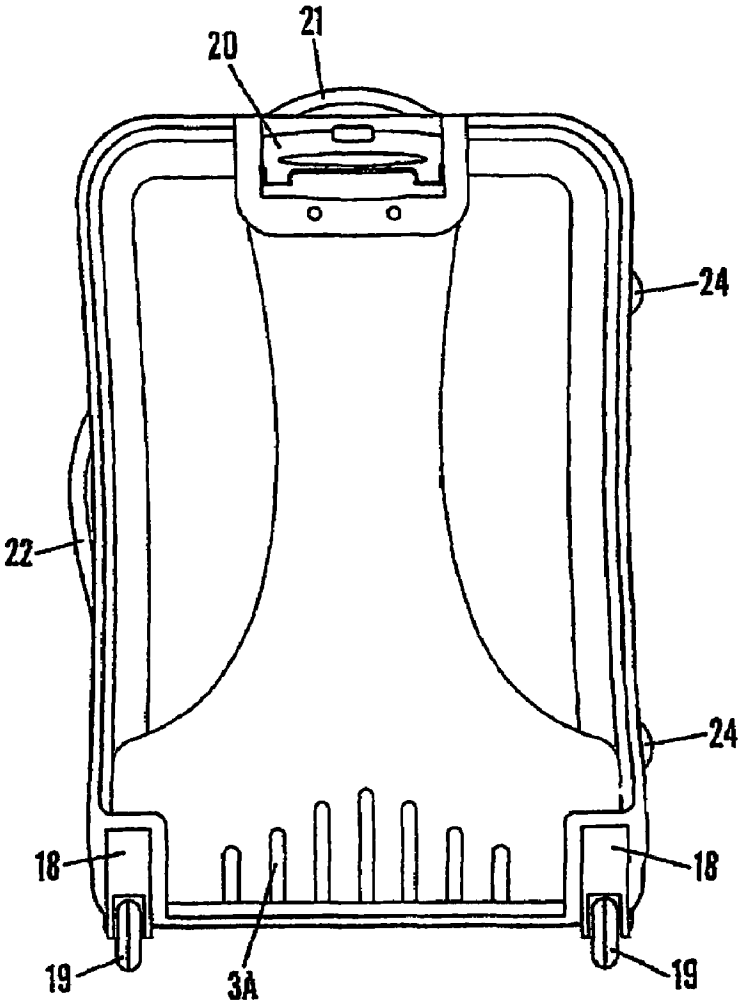
FIG. 6 is a face view of the opposite side of the case as shown in FIG. 5.
Figure 5:
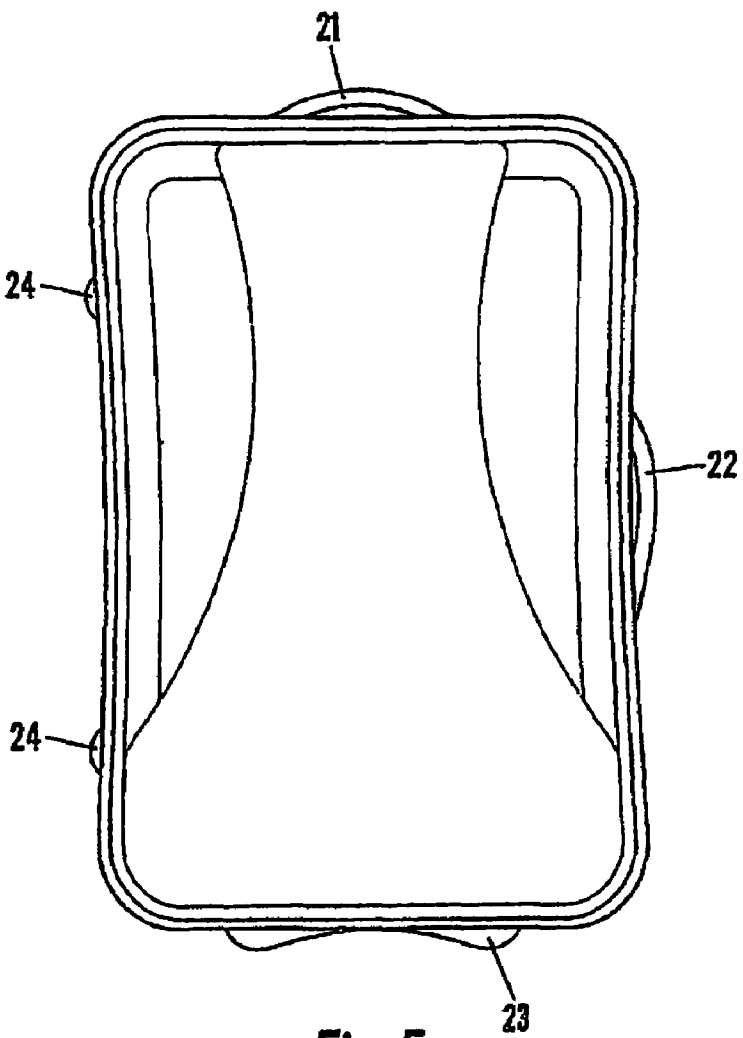
FIG. 5 is a face view of the suitcase shown in FIGS. 1 to 4.

As will be noted from the FIGS. 1 to 6, the side walls of the base portion and the lid portion are curved inwardly as particularly shown in FIGS. 5 and 6.

In addition, the central sections of the larger face 3 of the base portion 1 and the larger face 8 of the lid portion are raised relative to the remainder of the associated larger face. The larger face of the base portion 1 is additionally provided with a plurality of raised rib formations 3A in the region of the wheel housings 18.

Furthermore as may be noted from FIGS. 1 and 2 the larger face of the base portion 1 is inwardly curved.

Also the walls of the base portion in the vicinity of the handles 21 and 22 are countersunk so as to provide space for the fingers of the user when using the handles.

One of the functions of the raised and curved formations of the base and the lid portions is to provide for additional strength of the base and the lid portions since the provision of such formations is effective for stiffening of the larger areas of the suitcase to reduce flexure in use.

In addition the curved formation of the base and lid portions without changes in the wall thickness, and therefore weight variation enables these portions to be ergonomically enhanced as compared with the traditional purely rectangular flat surfaces construction.

In practice the utilisation of the curved formation as shown in the Figures (e.g., the lid portion being shaped so as to have a convex main outer surface 8 and the base portion being shaped so as to have a convex main outer surface 3) has been found to enhance the handling of the case by a user. For example the lengthways curving of the base surface 3 leads to more comfortable handling whilst the case is being carried using the handle 22.

It will be appreciated that the provision of a carrying handle implies that a person carrying the suitcase by way of the handle will for what ever reason from time to time set the case down into the floor/ground.

As a consequence of this in order to avoid damage and/or disfigurement to the suitcase the suitcase is provided with support elements which are intended to support the actual base and lid portions away from floor/ground contact.

In the case of the carrying handle 21 a support bar 23 is provided on the end wall 12 of the lid portion, the support bar being shaped as shown in FIG. 5. This bar is so dimensioned such that when the suitcase is oriented as shown in FIGS. 1 and 2 the suitcase is supported in a generally vertical setting.

In the case of the carrying handle 22 a group of four support elements 24 are provided, two on the side wall 3 of the base portion and two on the wall 10 of the lid portion.

Figure 8:
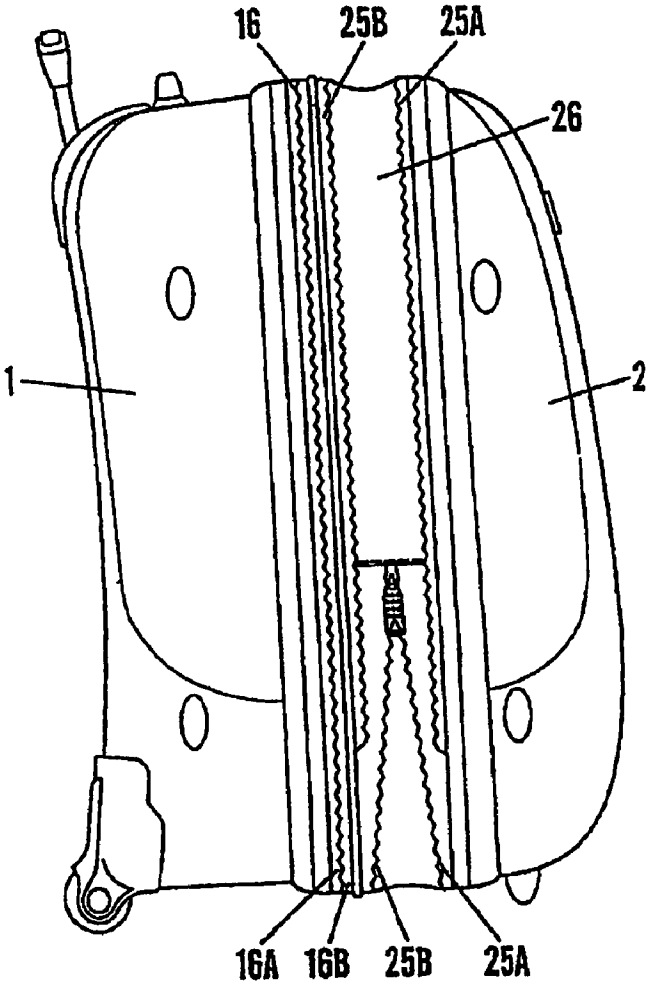
FIG. 8 is a side view of the suitcase of FIG. 7 when the suitcase is expanded.
Figure 7:
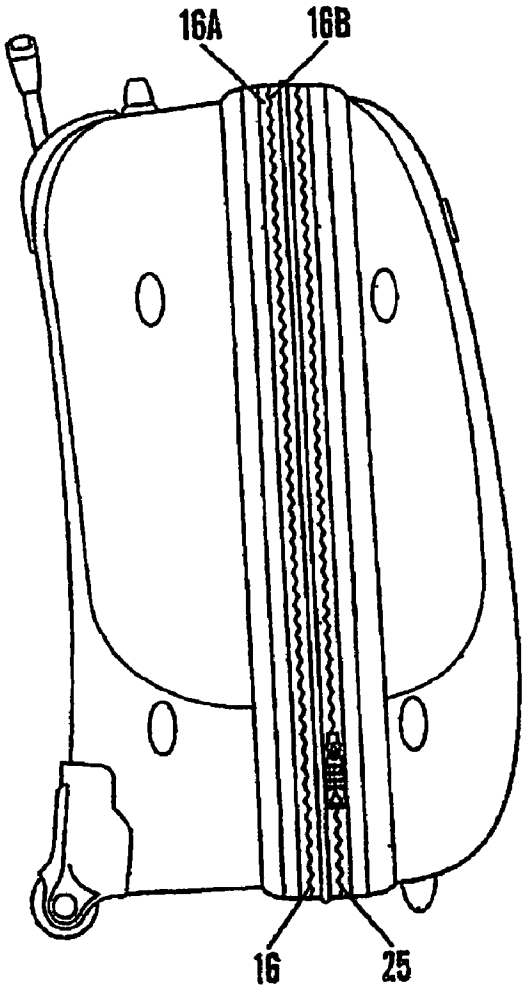
FIG. 7 is a side view of a second embodiment of a suitcase which is volume wise expandable the Figure illustrating the suitcase when unexpanded.

FIGS. 7 and 8 illustrate a modified construction of the suitcase shown in the FIGS. 1 to 6. The construction of the suitcase of FIGS. 7 and 8 is generally similar to that of the FIGS. 1 to 6. The essential differences is that the suitcase of FIGS. 7 and 8 is provided with the facility of expandability in volume.

This expandability is achieved by providing an additional double Zip fastener arrangement 25. One of the tooth strips/sections 25A of the fastener arrangement 25 is stitched to the lid portion 2. The other toothed strip/section 25B of the fastener arrangement is attached to the section of the fastener arrangement 16 associated with toothed strip 16B. Conveniently a beading/piping is interposed between the strip 16B and the section 25B, the latter serving to enhance appearance to provide a degree of stiffness around the case in the vicinity of the Zips 16 and 25. A flexible band or gusset 26 is provided between the toothed strips 25A and 25B of the fastener arrangement 25. The provision of this gusset enables the lid portion 2 to be bodily moved away from the base portion to an extent defined by the width of the gusset 26.

With this arrangement when both the Zip fastener arrangement 16 and the Zip fastener arrangement 26 are both in their closed positions as shown in FIG. 7 the suitcase is set to its minimum volume and is in its closed condition.

When the Zip fastener arrangement 16 is closed as is shown in FIG. 8 and the zip fastener arrangement 25 is open as is schematically indicated in FIG. 8 the lid portion is bodily movable away from the base portion by a distance defined by the width of the gusset 26 to increase the overall volume of the case whilst the case remains closed.

Bearing in mind that the material forming the Zip fastener sections/strips is conventionally a woven material, it has been appreciated that for the purposes of avoidance of damage to the woven material in the vicinity of the regions thereof that are stitched to the base and lid portions 1 and 2, and additionally to enhance the appearance of the suitcase, those regions of the Zip fasteners strips/sections that are involved in the stitching process are covered by a cover strip 30 (FIG. 9) that is secured to the associated base and lid portions 1 and 2 by the stitching operation involved in securing the associated Zip fastener section/strip to the base and lid sections of the case.

Figure 9:
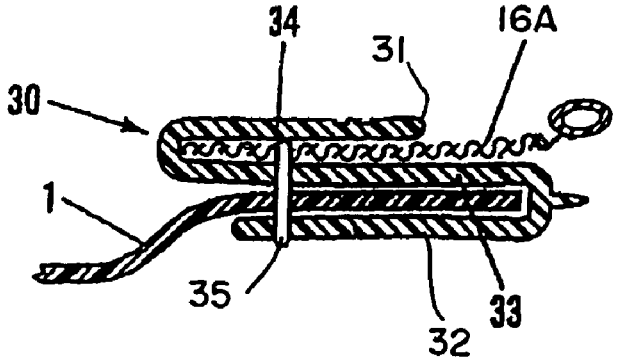
FIG. 9 is a cross sectional view of a detail of the suitcase construction to an enlarged scale.

As shown in FIG. 9, the cover strip 30 is formed by an generally compressed S cross-sectioned plastics material strip 31 providing an outer layers 32 and 34 and a central layer 33. The layers 32 and 33 combine to form a U recess into which is inserted the rim region of the bottom section 1 or that of the lid section 2. The layers 33 and 34 combine to form a second recess facing opposite direction to the first mentioned recess. The associated section/strip (16A, 16B or 16A, 25A) of the Zip fastener arrangements 16 and 25 is located within this second recess. With this arrangement layer 34 of plastics material overlies the associated Zip fastener section/strip and effectively hides the Zip fastener portion involved from view and gives additional strength to the stitching of the Zip fastener in place by the line of stitching 35.

It will be appreciated that closure of the Zip arrangement 25 will draw the lid portion 2 towards the base section 1 and thus reduce the overall case volume to that defined by the shaping of the base and lid portions.

If it is desired to provide for a double expansion of the volume of the overall volume of the case the base portion can be achieved by providing a further Zip Fastener arrangement (not shown) between the fastener arrangements 16 and 25.

In this construction the case will incorporate three Zip formations, two associated with the expandability of the case and the third associated with the opening and closing of the case.

The utilisation of a material to form the base and lid portions that retain their body shape whilst being capable of being stitched to Zip fastener arrangements has enabled the elimination of internal framing such as conventionally incorporated in the forms of 'hard' cases and has also enabled the elimination of the need for relatively heavy mechanical case locking arrangements together with heavy tongue and groove features conventionally used with the so-called 'hard' cases. This combination has effectively resulted in a hard case construction with significant reduction in weight as compared with equivalently sized conventional 'hard' case.

In addition, it will be appreciated that the construction proposed by the present invention has enabled the introduction of the feature content volume expansion into a hard case construction.

It has been found that the case construction as above discussed has resulted in a case construction that has been found easier to handle as compared with equivalent sized 'hard' cases.

The invention claimed is:

1. A hard suitcase comprising a base portion, a lid portion, the base portion and lid portion being formed of a plastics material of such characteristic that the base portion and lid portion retain their respective formed shape, the plastics material from which the base and lid portions are formed comprising a mixture of polycarbonate material with an Acrylic Butyl Styrene (ABS) material, and an expandable zip fastener arrangement having respective first and second zipped portions that are stitched to the base portion and stitched to the lid portion with respective securing threads, the zip fastener arrangement being operable to permit volume expansion of the hard suitcase.

2. The hard suitcase of claim 1, wherein the lid portion is shaped so as to have a convex main outer surface and the base portion is shaped so as to have a concave main outer surface.

3. The hard suitcase of claim 1, wherein the base portion and the lid portion each have a tray like shape with respective free edge regions and the first and second zipped portions of the zip fastener arrangement are secured with respective securing threads to the respective free edge regions.

4. The hard suitcase of claim 3, further comprising a cover strip having an S cross-section with first, second and third layers; the free edge region of one of the base and lid portions being situated between the first and second layers; a woven portion of the zip fastener arrangement being situated between the second and third layers; the respective securing thread extending through the first and second layers, through the free edge region of the associated one of the base and lid portions, and through the woven portion of the zip fastener arrangement but not through the third layer; and the third layer covering the thread but not covering teeth of the zip fastener arrangement.

5. The hard suitcase of claim 3, wherein the free edge regions of the base and lid portions are molded in a manner so as to serve as stiffening ribs.

6. The hard suitcase of claim 1, further comprising a first set of floor engageable support members, some of which are coupled to a first side wall of the base portion and some of which are coupled to a second side wall of the lid portion and further comprising at least one additional floor engageable support member coupled to a bottom wall of the lid portion.

7. The hard suitcase of claim 6, further comprising a pair of wheels/rolls coupled to bottom corner regions of the base portion, the floor engageable support members and the wheels/rolls being arranged such that, when the hard suitcase is supported on a floor in a first orientation, the first set of floor engageable support members contact the floor with the additional floor engageable support member and the pair of wheels/rolls being spaced from the floor and such that, when the hard suitcase is supported on the floor in a second orientation, the additional floor engageable support member and the pair of wheels/rolls contact the floor with the first set of floor engageable support members being spaced from the floor.

8. The hard suitcase of claim 1, further comprising a retractable towing handle assembly and a carrying handle coupled to a top wall of the base portion.

9. The hard suitcase of claim 8, wherein the base portion is molded with a recess for accommodating the retractable towing handle assembly.

10. The hard suitcase of claim 8, wherein the base portion has a concave main outer surface and the retractable towing handle assembly is situated adjacent the concave main outer surface.

11. The hard suitcase of claim 8, further comprising a second carrying handle coupled to a side wall of the base portion.

12. The hard suitcase of claim 1, further comprising a pair of wheel housings coupled to corner regions of the base portion and a pair of wheels/rolls each of which is coupled to a respective one of the pair of wheel housings.

13. The hard suitcase of claim 12, wherein a main outer wall of the base is provided with a plurality of raised rib formations in a region between the pair of wheel housings.

14. The hard suitcase of claim 1, further comprising a carrying handle coupled to a wall of the base portion and a part of the wall in the vicinity of the handle is countersunk to provide space for fingers of a user when using the handle.

15. The hard suitcase of claim 14, further comprising a second handle coupled to a second wall of the base portion and a part of the second wall in the vicinity of the second handle is countersunk to provide space for the user's fingers.

16. The hard suitcase of claim 1, wherein the second zipped portion that is stitched to the lid portion includes a gusset that provides for the volume expansion of the hard suitcase.

17. The hard suitcase of claim 16, wherein the second zipped portion includes a pair of tooth strips that, when zipped together, configure the hard suitcase for a minimum volume, and when unzipped, configure the hard suitcase for in expanded volume.

* * * * *